US009190812B2

(12) United States Patent
Miyashita et al.

(10) Patent No.: US 9,190,812 B2
(45) Date of Patent: Nov. 17, 2015

(54) SPARK PLUG AND ASSEMBLING STRUCTURE THEREOF

(75) Inventors: Naomichi Miyashita, Kasugai (JP); Yuuichi Nakano, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 74 days.

(21) Appl. No.: 14/113,390

(22) PCT Filed: Apr. 9, 2012

(86) PCT No.: PCT/JP2012/059636
§ 371 (c)(1),
(2), (4) Date: Oct. 23, 2013

(87) PCT Pub. No.: WO2012/147503
PCT Pub. Date: Nov. 1, 2012

(65) Prior Publication Data

US 2014/0042894 A1 Feb. 13, 2014

(30) Foreign Application Priority Data

Apr. 28, 2011 (JP) ..... 2011-100938

(51) Int. Cl.
*H01T 13/32* (2006.01)
*H01T 13/08* (2006.01)
*F02P 13/00* (2006.01)

(52) U.S. Cl.
CPC *H01T 13/08* (2013.01); *F02P 13/00* (2013.01)

(58) Field of Classification Search
USPC ..... 313/144
See application file for complete search history.

(56) References Cited

U.S. PATENT DOCUMENTS

| | | | | |
|---|---|---|---|---|
| 2,941,105 | A | 6/1960 | Rickenbach | |
| 3,992,974 | A | 11/1976 | Miki et al. | 85/50 |
| 2004/0066124 | A1 * | 4/2004 | Kanao et al. | 313/135 |
| 2008/0098974 | A1 | 5/2008 | Fukuzawa et al. | 123/169 R |
| 2008/0203882 | A1 | 8/2008 | Kobayashi et al. | 313/141 |
| 2011/0025186 | A1 * | 2/2011 | Kunitomo et al. | 313/141 |

FOREIGN PATENT DOCUMENTS

| | | | |
|---|---|---|---|
| EP | 1965475 A1 | 9/2008 | H01T 13/08 |
| JP | H06283249 | 10/1994 | H01T 13/08 |
| JP | H11324878 | 11/1999 | F02B 23/10 |
| JP | 2002-289318 | 10/2002 | H01T 13/20 |
| JP | 2008-135370 | 6/2008 | H01T 13/08 |
| JP | 2008-232399 | 10/2008 | F16J 15/08 |

OTHER PUBLICATIONS

Form PCT/ISA/210—Int'l Search Report (from corresponding Int'l Patent App. No. PCT/JP2012/059636—2 pages (English version only).
European Search Report issued in corresponding European Patent Application No. 12776460, dated Sep. 19, 2014.

* cited by examiner

*Primary Examiner* — Nimeshkumar Patel
*Assistant Examiner* — Brenitra M Lee
(74) *Attorney, Agent, or Firm* — Kusner & Jaffe

(57) ABSTRACT

A spark plug having a metallic shell extending along an axis (CL1) and a solid annular gasket. The metallic shell has an externally threaded portion and a seat portion, and the gasket has an inside diameter smaller than the thread diameter of the externally threaded portion and is provided between the externally threaded portion and the seat portion. The forward end surface of the gasket has an inclined portion which inclines rearward with respect to the direction of the axis (CL1) from the radially outer side toward the raidally inner side. The thickness of the gasket along the axis (CL1) is 2.0 mm or less; the distance along the axis (CL1) between the outermost circumferential edge and the innermost circumferential edge of inclined portion is 0.02 mm to 0.12 mm; and the Vickers hardness of the gasket is 60 Hv or more.

11 Claims, 13 Drawing Sheets

SPARK PLUG AND ASSEMBLING STRUCTURE THEREOF

FIELD OF THE INVENTION

The present invention relates to a spark plug for use in a combustion apparatus, such as an internal combustion engine, and to an assembling structure of the spark plug in which the spark plug is mounted to the combustion apparatus.

BACKGROUND OF THE INVENTION

A spark plug is mounted to a combustion apparatus, for example, an internal combustion engine, and is used for igniting an air-fuel mixture in a combustion chamber. Generally, the spark plug includes an insulator having an axial bore. A center electrode is inserted into a forward end portion of the axial bore. A metallic shell is provided externally of the outer circumference of the insulator. A ground electrode has a proximal end portion joined to a forward end portion of the metallic shell and a forward end portion forming a spark discharge gap in cooperation with the center electrode. Also, the metallic shell has an externally threaded portion for mounting the spark plug to the combustion apparatus. A solid annular gasket may be attached to the screw neck of the externally threaded portion (refer to, for example, Japanese Patent Application Laid-Open (kokai) No. 2008-135370). When the spark plug is mounted to the combustion apparatus, the gasket provides airtightness between the spark plug (metallic shell) and the combustion apparatus.

Meanwhile, for example, if the spark plug is mounted to the combustion apparatus in such a positional relation that the ground electrode is present between a fuel injection device and the spark discharge gap, injected fuel hits against the back surface of the ground electrode. Accordingly, the presence of the ground electrode hinders the supply of an air-fuel mixture, potentially resulting in deterioration in ignition performance. Thus, according to a conceivable practice, the relative position of formation of a thread of the externally threaded portion in relation to a region of a forward end portion of the metallic shell where the ground electrode is fixed is set to a position corresponding to, for example, a thread-cutting start position of an internally threaded portion of a mounting hole of the combustion apparatus, whereby, when the spark plug is mounted to the combustion apparatus, the ground electrode is disposed at a fixed position in relation to a combustion chamber.

However, even when the thread of the externally threaded portion is formed at a predetermined relative position in relation to a forward end portion of the metallic shell (ground electrode), and the spark plug is mounted to the combustion apparatus with a predetermined tightening torque, the forward end portion of the metallic shell (ground electrode) may fail to be disposed at a fixed position in relation to the combustion chamber by the influence of, for example, frictional force generated between the gasket and the combustion apparatus.

The present invention has been conceived in view of the above circumstances, and an object of the invention is to provide a spark plug having a gasket which allows accurate establishment of the relative position of a forward end portion of the metallic shell (ground electrode) in relation to a combustion chamber in mounting the spark plug to a combustion apparatus, as well as an assembling structure of the spark plug in which the spark plug is mounted to the combustion apparatus.

SUMMARY OF THE INVENTION

Configurations suitable for achieving the above object will next be described in itemized form. If needed, actions and effects peculiar to the configurations will be described additionally.

Configuration 1: In accordance with a first embodiment, there is provided a spark plug comprising:

a tubular metallic shell extending along an axis and a solid annular gasket made of metal and provided externally of an outer circumference of the metallic shell, the metallic shell having an externally threaded portion formed on an outer circumference of a forward portion thereof and a seat portion formed on a rear side of the externally threaded portion and protruding radially outward, and the gasket having an inside diameter smaller than a thread diameter of the externally threaded portion and being provided between the externally threaded portion and the seat portion, the spark plug being characterized in that a forward end surface of the gasket has an inclined portion which inclines rearward with respect to a direction of the axis from a radially outer side toward a radially inner side, a thickness of the gasket along the axis is 2.0 mm or less, a distance along the axis between an outermost circumferential edge and an innermost circumferential edge of the inclined portion is 0.02 mm to 0.12 mm, and a Vickers hardness of the gasket is 60 Hv or more.

The "thickness of the gasket along the axis" means a thickness of the gasket along the axis of the gasket as measured across the following reference point. The reference point is defined as follows: as viewed in a section which contains the axis, a line segment is drawn orthogonally to the axis from an outermost circumferential portion of the outer side surface of the gasket to the inner side surface of the gasket; the line segment is trisected; and of trisecting points, the one on a side toward the outer circumference is defined as the reference point. The "Vickers hardness of the gasket" is defined as follows: as viewed in a section which contains the axis, a line segment which extends along the axis and passes through the reference point is drawn between the rear end surface and the forward end surface of the gasket, and hardness measured at the midpoint of the line segment is defined as hardness of the gasket. That is, a region where the "thickness of the gasket" and the "hardness of the gasket" are measured is located sufficiently away from the position of formation of a groove appearing in configuration 4, which will be described later, and is other than a locally thin region, and other than a region where hardening may arise as a result of performing working for forming the groove.

Furthermore, in the case where the forward end surface of the gasket has an inclined portion formed at a side toward the outer circumference thereof, and a curved surface is formed between the inclined portion and the outer side surface of the gasket as in the case of configuration 2, which will be described later, the "outermost circumferential edge of the inclined portion" means where an imaginary surface formed by extending the inclined portion toward a side of the outer circumference and an imaginary surface formed by extending the outer side surface of the gasket forward with respect to the direction of the axis intersect with each other. In the case where a curved surface is formed between the inclined portion and the inner side surface of the gasket (or the outer circumferential wall surface of the groove), the "innermost circumferential edge of the inclined portion" means where an imaginary surface formed by extending the inclined portion toward a side of the inner circumference and an imaginary surface formed by extending the inner side surface of the gasket (or the outer circumferential wall surface of the groove) forward with respect to the direction of the axis intersect with each other.

According to configuration 1 mentioned above, the forward end surface of the gasket has the inclined portion which inclines rearward from the radially outer side toward the radially inner side, and the distance along the axis between the outermost circumferential edge and the innermost circumferential edge of the inclined portion is 0.02 mm or more. Therefore, when the spark plug is mounted to the combustion apparatus, only an outer circumferential portion of the inclined portion is in contact with the seat surface of the combustion apparatus, thereby producing a wedge effect and, in turn, restraining a slip of the gasket on the seat surface. As a result, the generation of metal powder, such as aluminum powder, from the seat surface can be effectively restrained, so that friction between the forward end surface of the gasket and the seat surface of the combustion apparatus can be stabilized.

Also, according to configuration 1 mentioned above, the above-mentioned distance of the inclined portion is 0.12 mm or less, and the thickness of the gasket is 2.0 mm or less. Therefore, when the spark plug is mounted to the combustion apparatus with a predetermined tightening torque, the inclined portion of the gasket can be more reliably deformed (corrected) along the seat surface.

As mentioned above, according to configuration 1 mentioned above, the gasket can be rendered deformable relatively easily, and friction between the forward end surface of the gasket and the seat surface of the combustion apparatus can be stabilized. As a result, when the spark plug is mounted to the combustion apparatus with a predetermined tightening torque, the relative position of a forward end portion of the metallic shell in relation to the combustion chamber can be accurately set, and, in turn, the ground electrode can be more reliably disposed at a fixed position in relation to the combustion chamber.

Furthermore, according to configuration 1 mentioned above, the hardness of the gasket is 60 Hv or more. Therefore, when the gasket assumes a high temperature, for example, in the course of use of the combustion apparatus, thermal deformation of the gasket can be effectively restrained, so that the loosening of the spark plug can be reliably prevented. As a result, deterioration in airtightness of the combustion chamber can be more reliably prevented, and an accurately positioned condition [positional relation of the ground electrode (a forward end portion of the metallic shell) to the combustion chamber] can be maintained over a long period of time.

Configuration 2: In accordance with a second embodiment, there is provided a spark plug as described in configuration 1 mentioned above, wherein the gasket has a convexly curved surface portion formed between the forward end surface and an outer side surface thereof, and as viewed in a section which contains the axis, a radius of curvature of the curved surface portion is 0.2 mm or less.

The radius of curvature of the curved surface portion is not necessarily regular. In the case where the radius of curvature is not regular, the "radius of curvature of the curved surface portion" means the radius of an imaginary circle which, as viewed in the section containing the axis, passes through a boundary point between the outer side surface and the curved surface portion of the gasket, a boundary point between the forward end surface and the curved surface portion of the gasket, and a midpoint between the two boundary points on the outline of the curved surface portion.

According to configuration 2 mentioned above, the curved surface portion assumes a sufficiently small radius of curvature of 0.2 mm or less. Thus, when the spark plug is mounted to the combustion apparatus, the curved surface portion of the gasket is easily caught by the seat surface of the combustion apparatus, so that a slip of the gasket on the seat surface can be further restrained. As a result, friction between the forward end surface of the gasket and the seat surface can be further stabilized, and, when the spark plug is mounted to the combustion apparatus with a predetermined tightening torque, the relative position of the ground electrode in relation to the combustion chamber can be more accurately set.

Configuration 3: In accordance with a third embodiment, there is provided a spark plug according to configurations 1 or 2 mentioned above, wherein the gasket has a protrusion provided on a radially outer side of the inclined portion and protruding forward with respect to the direction of the axis.

According to configuration 3 mentioned above, when the spark plug is mounted to the combustion apparatus, the protrusion is easily caught by the seat surface of the combustion apparatus, so that a slip of the gasket on the seat surface can be more effectively restrained. As a result, friction between the forward end surface and the seat surface can be further stabilized, and the accuracy of positioning of the ground electrode in relation to the combustion chamber can be further improved.

Configuration 4: In accordance with a fourth embodiment, there is provided a spark plug according to any one of configurations 1 to 3 mentioned above, wherein the gasket has an annular groove about the axis on a radially inner side of the inclined portion, and the thickness of the gasket along the axis is 1.0 mm or more.

In order to prevent detachment of the gasket, the inside diameter of the gasket must be smaller than the thread diameter of the threaded portion. A possible way to reduce the inside diameter of the gasket is as follows: a jig having a protrusion is pressed against a portion of the gasket located on a side toward the inner circumference of the gasket so as to provide a groove in the gasket, whereby the inner side surface of the gasket is rendered to protrude radially inward. However, in this case, if the gasket does not have a sufficient thickness, breakage, such as a crack, may arise in the gasket in the course of forming the groove.

In this connection, according to configuration 4 mentioned above, the gasket has a sufficient thickness of 1.0 mm or more; therefore, breakage of the gasket can be more reliably prevented in the course of forming the groove. As a result, yield can be improved.

Configuration 5: In accordance with a fifth embodiment, there is provided a spark plug according to any one of configurations 1 to 4 mentioned above, wherein the Vickers hardness of the gasket is 150 Hv or less.

According to configuration 5 mentioned above, damage to a jig used to form the groove can be restrained, so that working performance can be improved. Also, since the gasket becomes easily deformable, when the spark plug is mounted to the combustion apparatus, the gasket can be more reliably deformed (corrected) along the seat surface of the combustion apparatus.

Configuration 6: In accordance with a sixth embodiment, there is provided a spark plug according to any one of configurations 1 to 5 mentioned above, further comprising:

an insulator provided internally of an inner circumference of the metallic shell and having an axial bore extending therethrough in the direction of the axis, a center electrode provided at a forward end portion of the axial bore, and a rodlike ground electrode fixed to the metallic shell with a distal end portion thereof forming a spark discharge gap in cooperation with a forward end portion of the center electrode, wherein the ground electrode is composed of a single electrode.

In the case where the ground electrode is composed of three or more electrodes having the same length and provided at intervals along the circumferential direction of the metallic shell, a spark discharge is generated substantially evenly between the center electrode and the plurality of electrodes. Therefore, even when the spark plug is mounted to the combustion apparatus in such a positional relation that one of the electrodes is present between a fuel injection device and a spark discharge gap, an air-fuel mixture is supplied to the spark discharge gaps formed between the other electrodes and the center electrode without any trouble; thus, an extreme deterioration in ignition performance is unlikely to arise.

By contrast, in the case where the ground electrode is composed of a single electrode, and only a single spark discharge gap is formed as in the case of configuration 6 mentioned above, when the spark plug is mounted to the combustion apparatus in such a positional relation that the ground electrode is present between a fuel injection device and the spark discharge gap, the supply of an air-fuel mixture to the spark discharge gap may be hindered, potentially resulting in an extreme deterioration in ignition performance.

In this connection, according to configurations 1, etc., mentioned above, when the spark plug is mounted to the combustion apparatus, the ground electrode can be more reliably disposed at a fixed position in relation to the combustion chamber, whereby a deterioration in ignition performance can be more reliably prevented. In other words, configurations 1, etc., mentioned above are particularly useful for a spark plug in which the ground electrode is composed of a single electrode, thereby forming only a single spark discharge gap.

Configuration 7: In accordance with a seventh embodiment, there is provided a spark plug according to any one of configurations 1 to 5 mentioned above, further comprising:

an insulator provided internally of an inner circumference of the metallic shell and having an axial bore extending therethrough in the direction of the axis, a center electrode provided at a forward end portion of the axial bore, and a rodlike ground electrode fixed to the metallic shell with a distal end portion thereof forming a spark discharge gap in cooperation with a forward end portion of the center electrode, wherein the ground electrode is composed of a single main electrode forming the spark discharge gap in cooperation with a forward end surface of the center electrode and a sub-electrode whose distal end portion faces a forward end portion of the insulator or a side surface of a forward end portion of the center electrode and which is shorter than the main electrode.

According to a conceivable practice, as in the case of configuration 7 mentioned above, the ground electrode is composed of a relatively long main electrode, and a sub-electrode which faces a forward end portion of the insulator and is shorter than the main electrode; a spark discharge is generated mainly across the spark discharge gap (main gap) formed between the main electrode and the center electrode; and, for example, under a special condition that the insulator is fouled with carbon, etc., a spark discharge is exceptionally generated between the center electrode and the sub-electrode so as to burn carbon, etc. Also, according to another conceivable practice, the ground electrode is composed of a relatively long main electrode, and a sub-electrode which faces the side surface of a forward end portion of the center electrode and is shorter than the main electrode, and, while a discharge voltage is reduced by means of the sub-electrode which faces the side surface of a forward end portion of the center electrode, a spark discharge is generated mainly across the spark discharge gap (main gap) formed between the main electrode and the center electrode. If a spark plug having such a configuration is mounted to the combustion apparatus in such a positional relation that the main electrode is present between the main gap and a fuel injection device, ignition performance may drastically deteriorate.

In this connection, according to configurations 1, etc., mentioned above, when the spark plug is mounted to the combustion apparatus, the main electrode can be more reliably disposed at a fixed position in relation to the combustion chamber, whereby a deterioration in ignition performance can be more reliably prevented. In other words, configurations 1, etc., mentioned above are particularly useful for a spark plug in which the ground electrode is composed of a single main electrode and a sub-electrode shorter than the main electrode.

Configuration 8: In accordance with the eighth embodiment, there is provided a spark plug according to any one of configurations 1 to 5 mentioned above, further comprising:

an insulator provided internally of an inner circumference of the metallic shell and having an axial bore extending therethrough in the direction of the axis, a center electrode provided at a forward end portion of the axial bore, and a rodlike ground electrode fixed to the metallic shell with a distal end portion thereof forming a spark discharge gap in cooperation with a forward end portion of the center electrode, wherein the ground electrode is composed of two electrodes facing each other with respect to the axis.

According to a conceivable practice, as in the case of configuration 8 mentioned above, the ground electrode is composed of two electrodes facing each other with respect to the axis. When a spark plug having such a configuration is mounted to the combustion apparatus in such a positional relation that one of the two electrodes is present between a fuel injection device and a spark discharge gap (first gap) formed between the one electrode and the center electrode, the one electrode hinders the supply of an air-fuel mixture to a spark discharge gap (second gap) formed between the center electrode and the other one of the two electrodes in addition to the supply of the air-fuel mixture to the first gap. Thus, there is a concern about an extreme deterioration in ignition performance.

In this connection, according to configurations 1, etc., mentioned above, when the spark plug is mounted to the combustion apparatus, the two electrodes can be disposed at respectively fixed positions in relation to the combustion chamber, whereby a deterioration in ignition performance can be more reliably prevented. In other words, configurations 1, etc., mentioned above are particularly useful for a spark plug in which the ground electrode is composed of two electrodes facing each other with respect to the axis.

Configuration 9: In accordance with a ninth embodiment, there is provided a spark plug according to any one of configurations 1 to 8 mentioned above, wherein, as viewed in a section which contains a center axis of the gasket, a width of a sectional region of the gasket between an innermost circumference and an outermost circumference along a direction orthogonal to the center axis is 2.7 mm or less.

In recent years, strong demand has arisen to reduce the size (diameter) of a spark plug. Accordingly, the metallic shell may have a relatively small diameter (for example, the externally threaded portion has a thread diameter of M10 or less). As compared with a case of using the metallic shell having a relatively large diameter, in the case of using the metallic shell having such a small diameter, a portion of the ground electrode fixed to and extending straight from the metallic shell is located closer to the spark discharge gap. Accordingly, as viewed from a fuel injection port, the range in which the ground electrode hides the entire spark discharge gap (when the spark plug is rotated about the axis while the spark discharge gap is viewed from the fuel injection port, the range corresponds to an angle of rotation of the spark plug until a portion of the spark discharge gap becomes visible again after the ground electrode hides the entire spark discharge gap) becomes relatively large. That is, there becomes wide the range of disposition of the ground electrode in which the supply of an air-fuel mixture to the spark discharge gap is hindered. Therefore, a spark plug having the metallic shell of a relatively small diameter involves a greater concern about deterioration in ignition performance.

In this connection, a relatively-small-diameter spark plug having the gasket whose width is 2.7 mm or less as in the case of configuration 9 mentioned above involves a greater concern about deterioration in ignition performance caused by deviation in the position of disposition of the ground electrode; however, through employment of configurations 1, etc., mentioned above, such a concern can be eliminated. In other words, configurations 1, etc., mentioned above are particularly useful for a spark plug which has a gasket having a width of 2.7 mm or less and is therefore particularly susceptible to deterioration in ignition performance caused by deviation in the position of disposition of the ground electrode.

Configuration 10: In accordance with a tenth embodiment, there is provided an assembling structure of a spark plug in which the spark plug according to any one of configurations 1 to 9 mentioned above is mounted to an internally threaded portion of a combustion apparatus, the spark plug comprising an insulator provided internally of an inner circumference of the metallic shell and having an axial bore extending therethrough in the direction of the axis, a center electrode provided at a forward end portion of the axial bore, and a ground electrode fixed to a forward end portion of the metallic shell with a distal end portion thereof forming a spark discharge gap in cooperation with a forward end portion of the center electrode, and an externally threaded portion of the metallic shell and the internally threaded portion of the combustion apparatus being formed such that, in a state in which the spark plug is mounted to the combustion engine, a center of the spark discharge gap of the spark plug is disposed at a predetermined relative position in relation to an inner wall surface of a combustion chamber of the combustion apparatus.

In the case where the ground electrode is composed of a single electrode, the "center of the spark discharge gap" means the midpoint of a line segment which connects the centers (the centers of gravity) of the opposed surfaces of the center electrode and the ground electrode, respectively, the opposed surfaces facing each other across the spark discharge gap. Also, in the case where the ground electrode is composed of a main electrode and a sub-electrode, the "center of the spark discharge gap" means the midpoint of a line segment which connects the centers (the centers of gravity) of the opposed surfaces of the center electrode and the main electrode, respectively, the opposed surfaces facing each other across the spark discharge gap. Furthermore, in the case where the ground electrode is composed of two electrodes facing each other with respect to the axis, the "center of the spark discharge gap" means the midpoint of a line segment which connects the centers (centroids) of the opposed surfaces of the center electrode and one of the two electrodes, respectively.

In the assembling structure of configuration 10 mentioned above, through employment of the spark plug of configurations 1, etc., mentioned above, the center of the spark discharge gap can be positioned very accurately in relation to the combustion chamber, whereby deterioration in ignition performance caused by positional deviation can be more reliably prevented.

DETAILED DESCRIPTION OF PREFERRED EMBODIMENTS

Figure 1:
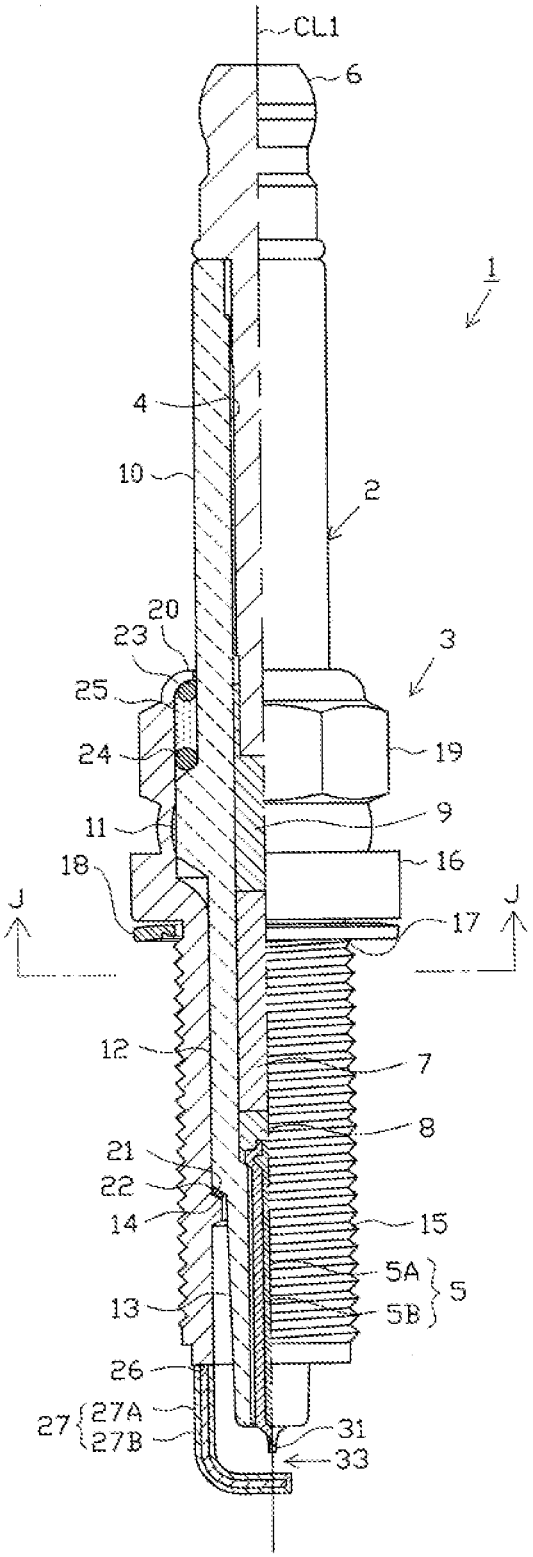
FIG. 1 is a partially cutaway front view showing the configuration of a spark plug.

An embodiment of the present invention will next be described with reference to the drawings. FIG. 1 is a partially cutaway front view showing a spark plug 1. In the following description, the direction of an axis CL1 of the spark plug 1 in FIG. 1 is referred to as the vertical direction, and the lower side of the spark plug 1 in FIG. 1 is referred to as the forward side of the spark plug 1, and the upper side as the rear side.

The spark plug 1 includes a ceramic insulator 2, which is a tubular insulator, and a tubular metallic shell 3 which holds the ceramic insulator 2 therein.

The ceramic insulator 2 is formed from alumina or the like by firing, as well known in the art. The ceramic insulator 2, as viewed externally, includes a rear trunk portion 10 formed on the rear side. A large-diameter portion 11 is located forward of the rear trunk portion 10 and projects radially outward. An intermediate trunk portion 12 is located forward of the large-diameter portion 11 and is smaller in diameter than the large-diameter portion 11. A leg portion 13 is located forward of the intermediate trunk portion 12 and is smaller in diameter than the intermediate trunk portion 12. The large-diameter portion 11, the intermediate trunk portion 12, and most of the leg portion 13 of the ceramic insulator 2 are accommodated within the metallic shell 3. A stepped portion 14 which tapers forward is formed at a connection portion between the intermediate trunk portion 12 and the leg portion 13. The ceramic insulator 2 is seated on the metallic shell 3 at the stepped portion 14.

Furthermore, the ceramic insulator 2 has an axial bore 4 extending therethrough along the axis CL1. A center electrode 5 is inserted into a forward end portion of the axial bore 4. The center electrode 5 includes an inner layer 5A formed of, for example, copper or a copper alloy, which has excellent thermal conductivity, and an outer layer 5B formed of a nickel alloy which contains nickel (Ni) as a main component. The center electrode 5 assumes a rodlike (circular columnar) shape as a whole, and its forward end portion protrudes from the forward end of the ceramic insulator 2. Furthermore, a noble metal tip 31 formed of a noble metal alloy (e.g., an iridium alloy or a platinum alloy) is provided on a forward end portion of the center electrode 5. The noble metal tip 31 may not be provided.

Also, a terminal electrode 6 is fixedly inserted into a rear end portion of the axial bore 4 and protrudes from the rear end of the ceramic insulator 2.

Furthermore, a circular columnar resistor 7 is disposed within the axial bore 4 between the center electrode 5 and the terminal electrode 6. The resistor 7 is electrically connected, at its opposite ends, to the center electrode 5 and the terminal electrode 6 via an electrically conductive glass seal layers 8 and 9, respectively.

Additionally, the metallic shell 3 is formed into a tubular shape from a low-carbon steel or a like metal. The metallic shell 3 has, on its outer circumferential surface, an externally threaded portion 15 adapted to mount the spark plug 1 into a mounting hole of a combustion apparatus (e.g., an internal combustion engine or a fuel cell reformer). Also, the metallic shell 3 has a collar-like seat portion 16 formed on the rear side of the externally threaded portion 15 and protruding radially outward. A ring-like gasket 18 (the configuration of the gasket 18 will be described later in detail) is fitted to the outer circumference of a cylindrical screw neck 17 located between the externally threaded portion 15 and the seat portion 16. Furthermore, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimped portion 20 provided at a rear end portion thereof for holding the ceramic insulator 2.

Also, the metallic shell 3 has, on its inner circumferential surface, a tapered, stepped portion 21 adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimped portion 20 is formed, whereby the ceramic insulator 2 is fixed to the metallic shell 3. An annular sheet packing 22 intervenes between the stepped portions 14 and 21. This retains airtightness of a combustion chamber and prevents outward leakage of fuel gas entering a clearance between the leg portion 13 of the ceramic insulator 2 and the inner circumferential surface of the metallic shell 3.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 through the sheet packing 22, the ring members 23 and 24, and the talc 25.

One end of a rodlike ground electrode 27 is joined to a forward end portion 26 of the metallic shell 3. In the present embodiment, the ground electrode 27 is composed of a single electrode and is bent at its intermediate portion such that a side surface of a distal end portion thereof faces the forward end surface (noble metal tip 31) of the center electrode 5. The ground electrode 27 includes an outer layer 27A formed of an Ni alloy [e.g., INCONEL 600 or INCONEL 601 (registered trademark)], and an inner layer 27B formed of, for example, a copper alloy or pure copper, which is superior in thermal conductivity and electrical conductivity to the Ni alloy. Furthermore, a spark discharge gap 33 is formed between the forward end surface of the center electrode 5 (noble metal tip 31) and a distal end portion (the other end portion) of the ground electrode 27. A spark discharge is performed across the spark discharge gap 33 in a direction substantially along the axis CL1.

Next, the configuration of the gasket 18, which is a feature of the present invention, will be described.

Figure 2:
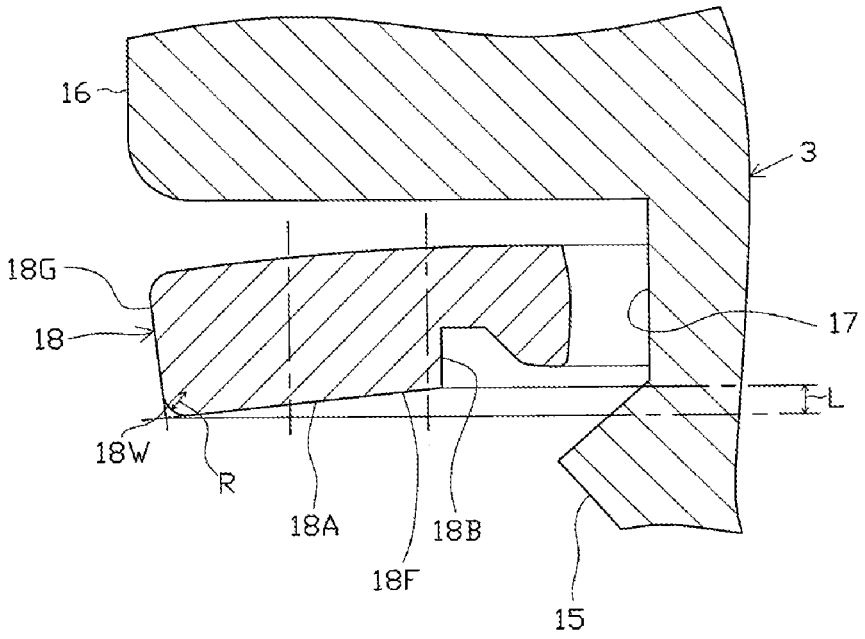
FIG. 2 is an enlarged fragmentary sectional view showing the configuration of a gasket.

The gasket 18 is formed of a predetermined metal having good thermal conductivity (e.g., an alloy which contains copper as a main component) and assumes a solid annular form. Also, as shown in FIG. 2, in order to prevent detachment of the gasket 18 from the metallic shell 3, the inside diameter of the gasket 18 is rendered smaller than the thread diameter of the externally threaded portion 15.

Furthermore, the forward end surface (a surface located on the forward side with respect to the direction of the axis CL1) 18F of the gasket 18 has an inclined portion 18A which inclines rearward with respect to the direction of the axis (CL1) from the radially outer side toward the radially inner side. In the inclined portion 18A, a distance L along the axis CL1 between its outermost circumferential edge (in the present embodiment, where an imaginary surface formed by extending the inclined portion 18A toward a side of the outer circumference and an imaginary surface formed by extending an outer side surface 18G of the gasket 18 forward with respect to the direction of the axis CL1 intersect with each other) and its innermost circumferential edge is 0.02 mm to 0.12 mm.

Figure 3:
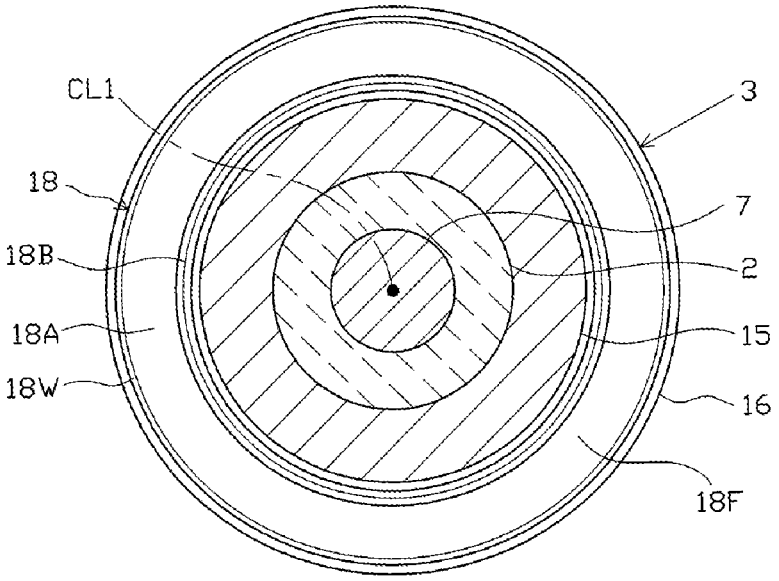
FIG. 3 is a sectional view taken along line J-J of FIG. 1, showing the configuration of a groove of the gasket.

Additionally, at the forward end surface 18F of the gasket 18, a concave groove 18B is formed on a radially inner side of the inclined portion 18A. As viewed in a section which contains the axis CL1, when the region occupied by the gasket 18 is trisected along a direction orthogonal to the axis CL1, the groove 18B is formed in a radially innermost region. Also, as shown in FIG. 3 (FIG. 3 is a sectional view taken along line J-J of FIG. 1), the groove 18B is formed annularly about the axis CL1 (slight deviation acceptable).

Figure 4:
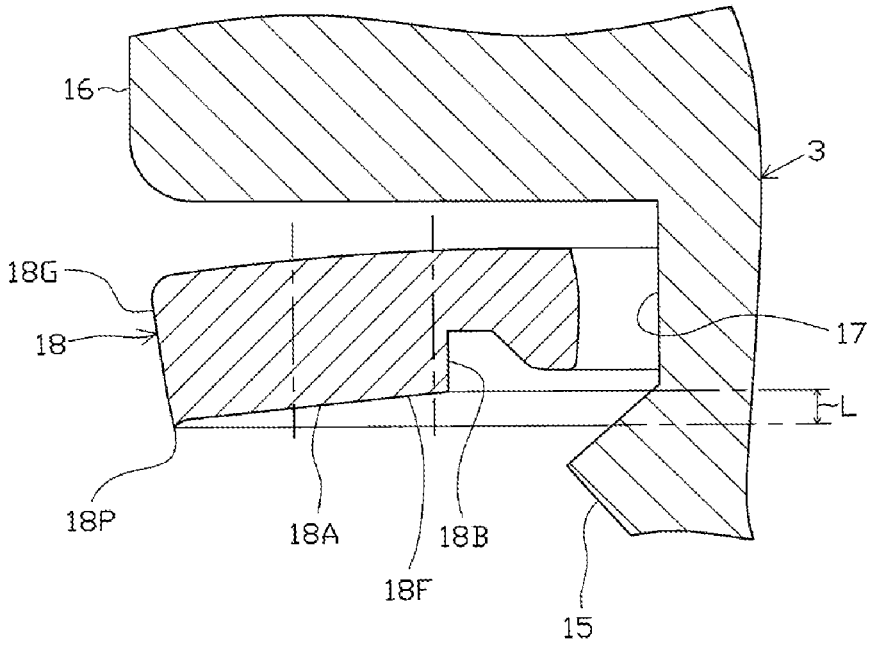
FIG. 4 is an enlarged fragmentary sectional view showing another example of the gasket.

Referring back to FIG. 2, the gasket 18 has a convexly curved surface portion 18W formed between the forward end surface 18F and the outer side surface 18G; however, the curved surface portion 18W has a relatively small radius of curvature so as to form an angular shape between the forward end surface 18F and the outer side surface 18G of the gasket 18. Specifically, as viewed in a section which contains the axis CL1, the radius of curvature R of the curved surface portion 18W is 0.2 mm or less. The radius of curvature of the curved surface portion 18W is not necessarily regular. In the case where the radius of curvature is not regular, the "radius R of curvature" means the radius of an imaginary circle which, as viewed in the section containing the axis CL1, passes through a boundary point between the outer side surface 18G and the curved surface portion 18W of the gasket 18, a boundary point between the forward end surface 18F and the curved surface portion 18W of the gasket 18, and a midpoint between the two boundary points on the outline of the curved surface portion 18W. Also, as shown in FIG. 4, the gasket 18 may have a protrusion 18P protruding forward with respect to the direction of the axis CL1 and provided at its portion located most forward with respect to the direction of the axis CL1 (i.e., on a radially outer side of the inclined portion 18A).

Figure 5:
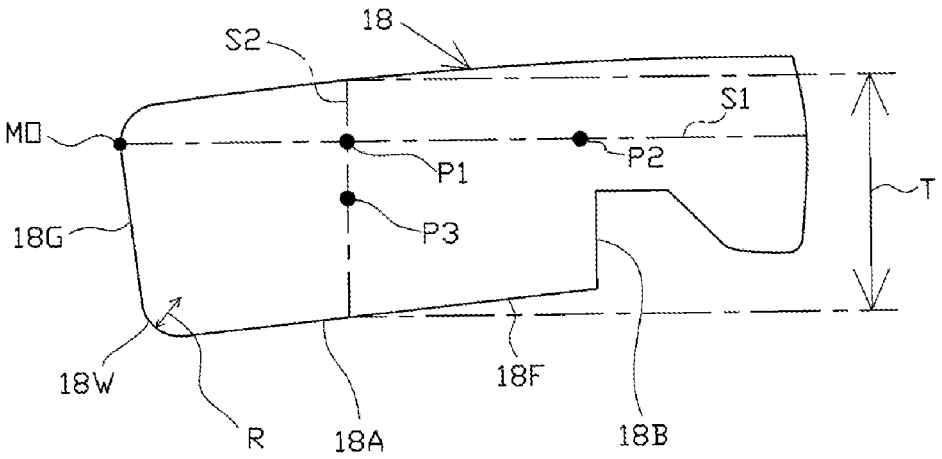
FIG. 5 is an enlarged schematic sectional view showing the positions of measuring the thickness and hardness of the gasket.

Furthermore, in the present embodiment, as shown in FIG. 5 (for convenience of illustration, hatching is omitted), a thickness T of the gasket 18 along the axis CL1 is 1.0 mm to 2.0 mm. The "thickness T" means, as viewed in a section which contains the axis CL1, the thickness of the gasket 18 measured along the axis CL1 at a radially outermost point P1 of trisecting points P1 and P2 of a line segment S1 drawn along a direction orthogonal to the axis CL1 from an outermost circumferential portion MO of the outer side surface 18G of the gasket 18 to the inner side surface of the gasket 18. That is, the "thickness T" means the thickness of a region of the gasket 18 other than a region where the thickness may locally differ, such as a portion of the groove 18B and the curved surface portion 18W.

Also, in the present embodiment, the hardness of the gasket 18 is 60 Hv to 150 Hv in Vickers hardness. The hardness of the gasket 18 means, as viewed in a section which contains the axis CL1, the hardness of the gasket 18 measured at a midpoint P3 of a line segment S2 extending along the axis CL1 from the rear end surface of the gasket 18 to the forward end surface 18F and passing through the aforementioned point P1. That is, the hardness of the gasket 18 means the hardness of a region of the gasket 18 other than a region where hardness may greatly vary, such as the vicinity of the groove 18B.

Figure 6:
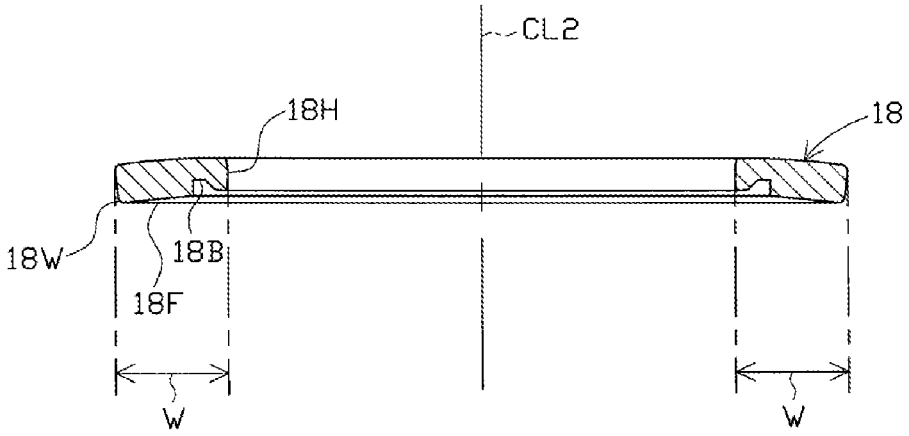
FIG. 6 is a sectional view of the gasket, showing the width, etc., of the gasket.

Furthermore, as shown in FIG. 6, as viewed in a section which contains a center axis CL2 of the gasket 18, the width W of a sectional region of the gasket 18 between the innermost circumference and the outermost circumference along a direction orthogonal to the center axis CL2 is 2.7 mm or less. The center axis CL2 of the gasket 18 means a straight line which connects the center of a forward end opening, with respect to the direction of the axis CL1, of a hole 18H provided at the center of the gasket 18 and the center of a rear end opening, with respect to the direction of the axis CL1, of the hole 18H. Also, in the present embodiment, the axis CL1 and the center axis CL2 of the gasket 18 coincide with each other.

Figure 7:
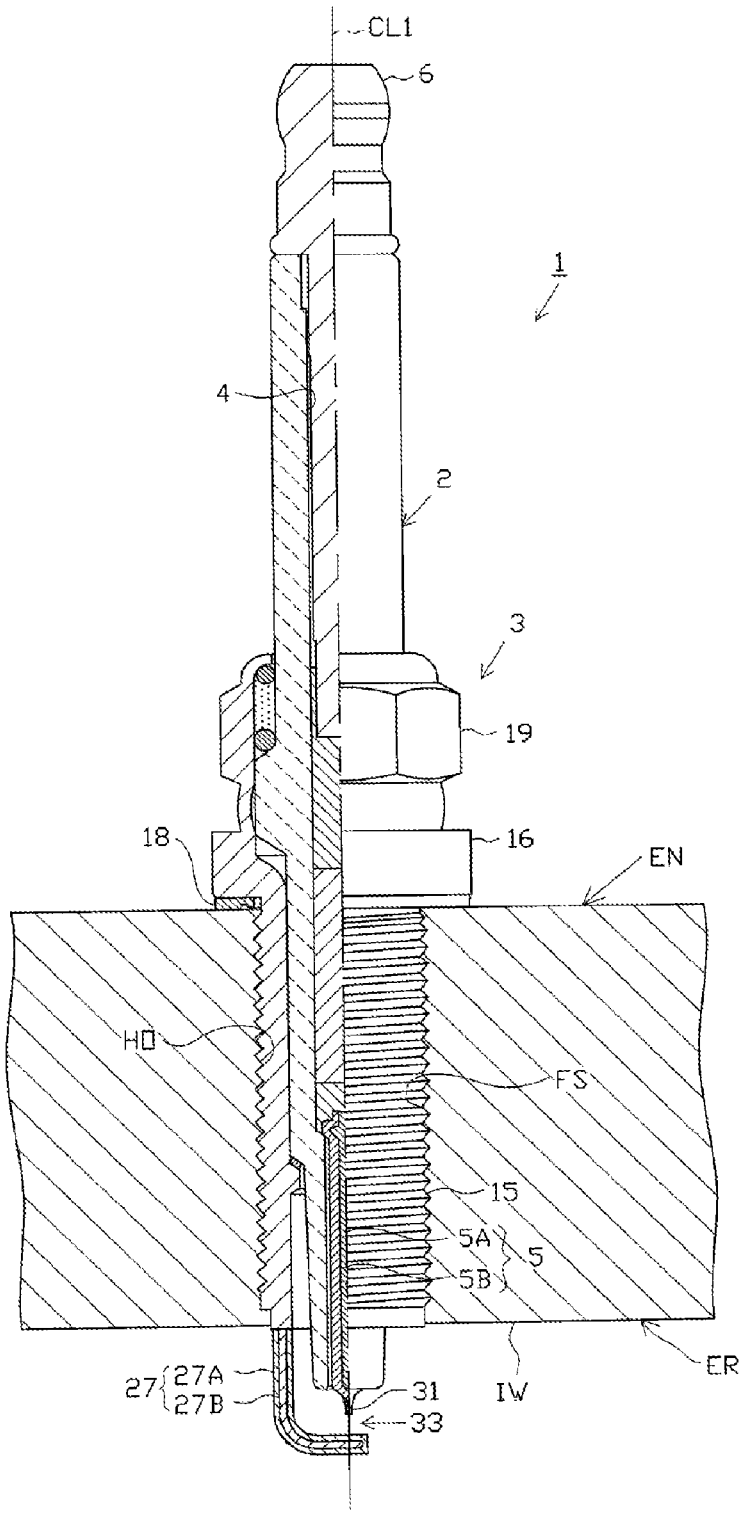
FIG. 7 is an enlarged partially cutaway front view showing the configuration of a combustion apparatus and the spark plug mounted to the combustion apparatus.

Additionally, the spark plug 1 is mounted, for use, to the combustion apparatus. As shown in FIG. 7, the externally threaded portion 15 and an internally threaded portion FS formed at a mounting hole HO of a combustion apparatus EN are formed such that, when the externally threaded portion 15 of the spark plug 1 is threadingly engaged with the internally threaded portion FS, the center of the spark discharge gap 33 is disposed at a predetermined relative position in relation to an inner wall surface IW of a combustion chamber ER. The center of the spark discharge gap 33 means the midpoint of a line segment which connects the centers (the centers of gravity) of the opposed surfaces of the center electrode 5 (noble metal tip 31) and the ground electrode 27, the opposed surfaces facing each other across the spark discharge gap 33.

Next, a method of manufacturing the spark plug 1 configured as mentioned above is described.

First, the metallic shell 3 is formed beforehand. Specifically, a circular columnar metal material (e.g., an iron-based material or a stainless steel material) is subjected to cold forging, etc., so as to form a general shape and a through hole. Subsequently, machining is conducted so as to adjust the outline, thereby yielding a metallic-shell intermediate.

Then, the straight rod-like ground electrode 27 formed of an Ni alloy or a like metal is resistance-welded to the forward end surface of the metallic-shell intermediate. The resistance welding is accompanied by formation of so-called "sags." After the "sags" are removed, the externally threaded portion 15 is formed in a predetermined region of the metallic-shell intermediate by rolling. Thus, the metallic shell 3 to which the ground electrode 27 is welded is obtained. In forming the externally threaded portion 15 by rolling, the relative positions of cutting start and cutting end of the externally threaded portion 15 in relation to the joined position of the ground electrode 27 are determined according to, for example, the cutting start position of the internally threaded portion FS formed at the mounting hole HO of the combustion apparatus EN. That is, the externally threaded portion 15 is formed by rolling such that, when the externally threaded portion 15 of the spark plug 1 is threadingly engaged with the mounting hole HO of the combustion apparatus EN, the ground electrode 27 is disposed at a fixed relative position in relation to the combustion apparatus EN.

Next, the metallic shell 3 to which the ground electrode 27 is welded is subjected to galvanization or nickel plating. In order to enhance corrosion resistance, the plated surface may be further subjected to chromate treatment.

Separately from preparation of the metallic shell 3, the ceramic insulator 2 is formed. Specifically, for example, a forming material granular-substance is prepared by use of a material powder which contains alumina in a predominant amount, a binder, etc. By use of the prepared forming material granular-substance, a tubular green compact is formed by rubber press forming. The thus-formed green compact is subjected to grinding for shaping. The shaped green compact is fired in a kiln, thereby yielding the ceramic insulator 2.

Also, separately from preparation of the metallic shell 3 and the ceramic insulator 2, the center electrode 5 is formed. Specifically, an Ni alloy in which a copper alloy or a like metal is disposed in a central region for improving heat radiation performance is subjected to forging, thereby yielding the center electrode 5. Next, the noble metal tip 31 formed of a noble metal alloy is joined to a forward end portion of the center electrode 5 by laser welding or the like.

Next, the ceramic insulator 2 and the center electrode 5, which are formed as mentioned above, the resistor 7, and the terminal electrode 6 are fixed in a sealed condition by means of the glass seal layers 8 and 9. The glass seal layers 8 and 9 are generally formed of a mixture of borosilicate glass and a metal powder. The mixture is charged into the axial bore 4 of the ceramic insulator 2 in such a manner that the resistor 7 is sandwiched between the charged portions of the mixture. Subsequently, while being pressed from the rear side by the terminal electrode 6, the charged mixture is baked through application of heat in a kiln. At this time, a glaze layer may be simultaneously formed on the surface of the rear trunk portion 10 of the ceramic insulator 2. Alternatively, the glaze layer may be formed beforehand.

Subsequently, the thus-formed ceramic insulator 2 having the center electrode 5 and the terminal electrode 6, and the metallic shell 3 having the ground electrode 27 are fixed together. More specifically, in a state in which the ceramic insulator 2 is inserted through the metallic shell 3, a relatively thin-walled rear-end opening portion of the metallic shell 3 is crimped radially inward; i.e., the above-mentioned crimped portion 20 is formed, thereby fixing the ceramic insulator 2 and the metallic shell 3 together.

Figure 8A:
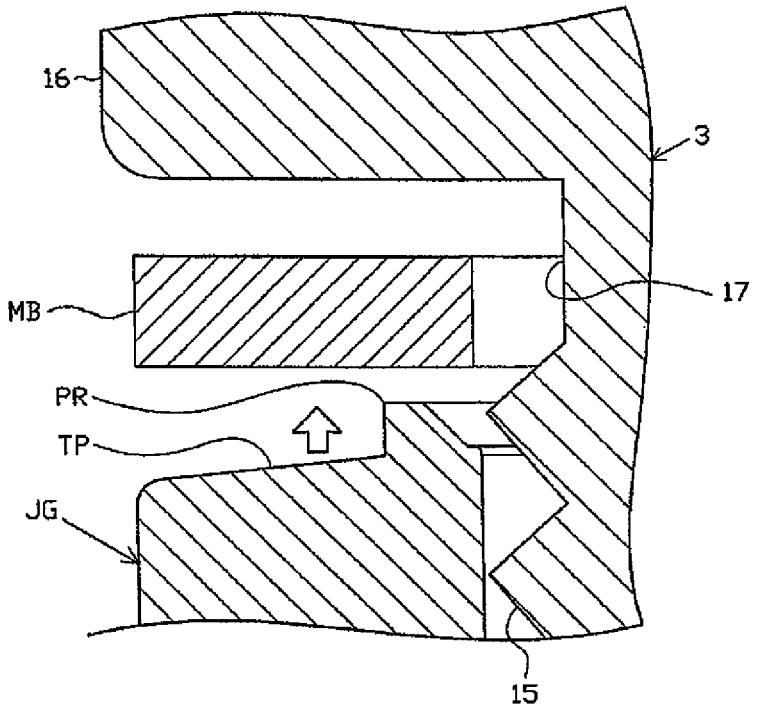
FIGS. 8(*a*) and 8(*b*) are enlarged fragmentary sectional views for explaining the process of forming a groove.
Figure 8B:
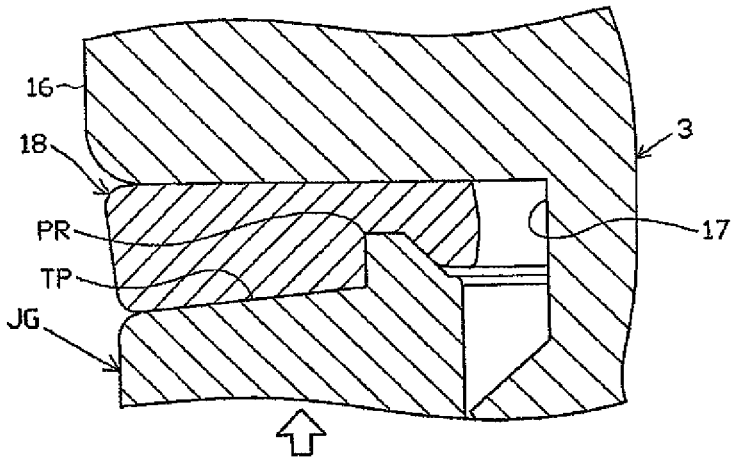

Next, the gasket 18 is attached to the outer circumference of the screw neck 17 of the metallic shell 3. First, a rolled copper alloy plate which contains Cu as a main component is subjected to blanking or the like, thereby yielding an annular metal plate having flat (i.e., the inclined portion 18A, etc., are not formed) opposite end surfaces (the forward end surface and the rear end surface). The surface of the obtained metal plate between the forward end surface and the outer side surface has a slightly curved shape (i.e., the curved surface portion 18W) or the protrusion 18P protruding forward as a result of working. As shown in FIG. 8(*a*), the obtained metal plate MB is fitted to the metallic shell 3 and is disposed externally of the outer circumference of the screw neck 17. Next, as shown in FIG. 8(*b*), a jig JG having an annular protrusion PR corresponding to the groove 18B, and a tapered portion TP corresponding to the inclined portion 18A and inclining radially inward and rearward with respect to the direction of the axis CL1 from the radially outer side is pressed against the forward end surface of the metal plate MB at a predetermined load (e.g., about 1.1 tons to 1.8 tons) imposed along the direction of the axis CL1. By this process, the metal plate MB is formed into the gasket 18 having the inclined portion 18A and the groove 18B. The inside diameter of the gasket 18 becomes smaller than the thread diameter of the externally threaded portion 15; and the gasket 18 is attached to the outer circumference of the screw neck 17.

Next, the ground electrode 27 is bent toward the center electrode 5, and the magnitude of the spark discharge gap 33 between the center electrode 5 and the ground electrode 27 is adjusted, thereby yielding the above-mentioned spark plug 1.

As described above in detail, according to the present embodiment, the forward end surface 18F of the gasket 18 has the inclined portion 18A, and the distance along the axis CL1 between the outermost circumferential edge and the innermost circumferential edge of the inclined portion 18A is 0.02 mm or more. Therefore, when the spark plug 1 is mounted to the combustion apparatus EN, only an outer circumferential portion of the inclined portion 18A is in contact with the seat surface of the combustion apparatus EN, thereby producing a wedge effect and, in turn, restraining a slip of the gasket 18 on the seat surface. As a result, the generation of metal powder, such as aluminum powder, from the seat surface can be effectively restrained, so that friction between the forward end surface 18F of the gasket 18 and the seat surface of the combustion apparatus EN can be stabilized.

Also, since the aforementioned distance L of the inclined portion 18A is 0.12 mm or less, and the thickness T of the gasket 18 is 2.0 mm or less, when the spark plug 1 is mounted to the combustion apparatus EN, the inclined portion 18A (warp) of the gasket 18 can be more reliably deformed (corrected) along the seat surface.

As described above, according to the present embodiment, the gasket 18 can be rendered deformable relatively easily, and friction between the forward end surface 18F of the gasket 18 and the seat surface of the combustion apparatus EN can be stabilized. As a result, when the spark plug 1 is mounted to the combustion apparatus EN with a predetermined tightening torque, the relative position of a forward end portion of the metallic shell 3 in relation to the combustion chamber ER along the axis CL1 can be accurately set, and, in turn, the ground electrode 27 (the center of the spark discharge gap 33) can be more reliably disposed at a fixed position in relation to the combustion chamber ER.

Also, since the curved surface portion 18W assumes a sufficiently small radius R of curvature of 0.2 mm or less, when the spark plug 1 is mounted to the combustion apparatus EN, the curved surface portion 18W is easily caught by the seat surface of the combustion apparatus EN, so that a slip of the gasket 18 on the seat surface can be further restrained. As a result, friction between the forward end surface 18F of the gasket 18 and the seat surface can be further stabilized, and the relative position of the ground electrode 27 in relation to the combustion chamber ER can be more accurately set.

Furthermore, since the hardness of the gasket 18 is 60 Hv or more, thermal deformation of the gasket 18 can be effectively restrained, so that the loosening of the spark plug 1 can be reliably prevented. As a result, deterioration in airtightness of the combustion chamber can be more reliably prevented, and the accurately set relative position of the ground electrode 27 in relation to the combustion chamber ER can be maintained over a long period of time.

Also, since the gasket thickness T assumes a sufficiently large value of 1.0 mm or more, breakage of the gasket 18 can be more reliably prevented in the course of forming the groove 18B, and yield can be thereby improved.

Additionally, since the gasket 18 has a hardness of 150 Hv or less, damage to the jig JG used to form the groove 18B can be restrained, so that working performance can be improved.

Also, in the case where the ground electrode 27 is composed of a single electrode, and only a single spark discharge gap 33 is formed as in the case of the present embodiment, when the spark plug 1 is mounted to the combustion apparatus EN in such a positional relation that the ground electrode 27 is present between a fuel injection device and the spark discharge gap 33, the supply of an air-fuel mixture to the spark discharge gap 33 may be hindered, potentially resulting in an extreme deterioration in ignition performance. However, according to the present embodiment, when the spark plug 1 is mounted to the combustion apparatus EN, the ground electrode 27 can be more reliably disposed at a fixed position in relation to the combustion chamber ER. Therefore, a deterioration in ignition performance can be more reliably prevented. In other words, the above-mention configuration for accurately establishing the relative position of the ground electrode 27 in relation to the combustion chamber ER is particularly useful for a spark plug 1 in which the ground electrode 27 is composed of a single electrode, and only a single spark discharge gap 33 is thereby formed.

Next, in order to verify actions and effects to be yielded by the above embodiment, there were manufactured spark plug samples having respective gaskets which differed in the distance L along the axis between the outermost circumferential edge and the innermost circumferential edge of the inclined portion. The samples were subjected to a positioning-accuracy evaluation test. The outline of the positioning-accuracy evaluation test is as follows. Each of the samples was mounted, with a predetermined tightening torque, to an aluminum test bed which simulated a combustion apparatus, and there was measured a positional deviation along the axis CL1 of the forward end surface of the center electrode from a target standard position. A sample having a positional deviation of less than 0.1 mm was evaluated as "Good," indicating that a forward end portion of the metallic shell (ground electrode) can be accurately positioned in relation to the combustion apparatus. A sample having a positional deviation of 0.1 mm to less than 0.2 mm was evaluated as "Fair," indicating that positioning accuracy is somewhat inferior. A sample having a positional deviation of 0.2 mm or more was evaluated as "Poor," indicating that positional accuracy is inferior. The following two groups of samples were prepared: in one group, the thread diameter of the externally threaded portion was M12, and the width W of the gasket was 2.8 mm; and in the other group, the thread diameter of the externally threaded portion was M10, and the width W of the gasket was 2.7 mm. Table 1 shows the test results of the samples in which the thread diameter of the externally threaded portion was M12 and in which the width W of the gasket was 2.8 mm. Table 2 shows the test results of the samples in which the thread diameter of the externally threaded portion was M10 and in which the width W of the gasket was 2.7 mm. The samples were 4 mm in the distance along the axis CL1 (the amount of protrusion) between the forward end of the metallic shell and the forward end of the center electrode. Each of the gaskets of the samples had the curved surface portion having a radius of curvature R of 0.1 mm or 0.3 mm. Additionally, the distance L was varied through adjustment of a load imposed on the jig in forming the groove (Tables 1 and 2 show, for reference, a load imposed in forming the groove). Furthermore, the Vickers hardness of the gasket was 80 Hv, and the thickness T of the gasket was 2.0 mm or less.

TABLE 1

| Thread dia. = M12, W = 2.8 mm | | | |
|---|---|---|---|
| | | Evaluation | |
| Distance L (mm) | Load (ton) | R = 0.1 mm | R = 0.3 mm |
| 0.00 | 0.50 | Poor | Fair |
| 0.01 | 0.90 | Fair | Fair |
| 0.02 | 1.10 | Good | Good |
| 0.03 | 1.30 | Good | Good |
| 0.04 | 1.50 | Good | Good |
| 0.08 | 1.70 | Good | Good |
| 0.09 | 1.75 | Good | Good |
| 0.12 | 1.80 | Good | Good |
| 0.19 | 1.90 | Fair | Fair |
| 0.23 | 2.00 | Poor | Fair |

TABLE 2

| Thread dia. = M10, W = 2.7 mm | | | |
|---|---|---|---|
| | | Evaluation | |
| Distance L (mm) | Load (ton) | R = 0.1 mm | R = 0.3 mm |
| 0.00 | 0.40 | Poor | Poor |
| 0.01 | 0.80 | Poor | Poor |
| 0.02 | 0.90 | Good | Good |
| 0.03 | 1.10 | Good | Good |
| 0.04 | 1.30 | Good | Good |
| 0.08 | 1.40 | Good | Good |
| 0.09 | 1.50 | Good | Good |
| 0.12 | 1.55 | Good | Good |
| 0.19 | 1.60 | Poor | Poor |
| 0.23 | 1.70 | Poor | Poor |

As shown in Tables 1 and 2, the samples having a distance L of less than 0.02 mm show relatively large positional deviations, indicating that the samples are inferior in positioning accuracy. Conceivably, this is for the following reason: when the samples were mounted to the test bed, the forward end surfaces of the gaskets slipped on the seat surface of the test bed, thereby generating aluminum powder from the test bed, so that friction between the gaskets and the seat surface of the test bed became unstable.

Also, it has been confirmed that the samples having a distance L of greater than 0.12 mm are inferior in positioning accuracy. Conceivably, this is for the following reason: the inclined portions (warps) expected to be corrected through mounting to the test bed remained uncorrected.

Additionally, as shown in Table 2, in the case of the samples having a thread diameter of the threaded portion of M10 and a width W of 2.7 mm, when the distance L is less than 0.02 mm or in excess of 0.12 mm, the positional deviation of the ground electrode is very likely to arise.

By contrast, in the case of the samples having a distance L of 0.02 mm to 0.12 mm, the positional deviation is less than 0.1 mm, indicating that positioning accuracy is superior.

Next, there were manufactured spark plug samples which differed in the thickness T (mm) of the gasket. The samples were subjected to the positioning-accuracy evaluation test mentioned above. Table 3 shows the results of the test. The samples had a distance L of 0.08 mm and a Vickers hardness of the gasket of 80 Hv.

TABLE 3

| | Thickness T (mm) | | | | | | | |
|---|---|---|---|---|---|---|---|---|
| | 0.5 | 0.8 | 1.0 | 1.2 | 1.5 | 2.0 | 2.5 | 3.0 |
| Evaluation | Good | Good | Good | Good | Good | Good | Poor | Poor |

As shown in Table 3, it has been confirmed that the samples having a thickness T of greater than 2.0 mm are inferior in positioning accuracy. Conceivably, this is for the following reason: similar to the case of a distance L of greater than 0.12 mm, when the samples were mounted to the test bed, the inclined portions of the gaskets were not corrected.

By contrast, it has become evident that, in the case of the samples having a thickness T of 2.0 mm or less, positioning can be accurately performed.

From the results of the tests mentioned above, in order to allow accurate disposition of a forward end portion of the metallic shell (ground electrode) at a predetermined position when the spark plug is mounted to the combustion apparatus, preferably, the distance L along the axis between the outermost circumferential edge and the innermost circumferential edge of the inclined portion is 0.02 mm to 0.12 mm, and the thickness T of the gasket is 2.0 mm or less.

Also, the employment of a distance L of 0.02 mm to 0.12 mm and a thickness T of 2.0 mm or less can be said to be particularly effective for a spark plug which is 2.7 mm or less in the width W of the gasket and is therefore very susceptible to positional deviation of a forward end portion of the metallic shell (ground electrode).

Next, there were manufactured spark plug samples which differed in hardness of the gasket. The samples were subjected to a loosening evaluation test. The outline of the loosening evaluation test is as follows. The samples were mounted to predetermined aluminum bushes with a predetermined standard torque Ts (N·m). Then, while the temperature of forward end portions of the samples was varied in a range of 50° C. to 200° C., vibration was applied to the samples on the basis of the vibration test specified in ISO11565 [a test of applying vibration load in the horizontal and vertical directions for eight hours each at a sweep of 50 Hz to 500 Hz (one octave/min)]. After the vibration test, a return torque Te (N·m) required to remove the samples from the bushes was measured, and the ratio of the return torque Te to the standard torque Ts was calculated. The samples having a Te/Ts of 10% or more were evaluated as "Good," indicating that the loosening of the spark plugs can be sufficiently restrained even in a very severe environment. The samples having a Te/Ts of less than 10% were evaluated as "Poor," indicating the loosening of the spark plugs is more likely to arise in a severe environment. Table 4 shows the results of the test. The samples employed a load of 1.5 t in forming the groove.

TABLE 4

| | Hardness of gasket (Hv) | | | | | | | |
|---|---|---|---|---|---|---|---|---|
| | 40 | 50 | 60 | 80 | 100 | 150 | 180 | 200 |
| Evaluation of loosening | Poor | Poor | Good | Good | Good | Good | Good | Good |

As is apparent from Table 4, through employment of a Vickers hardness of the gasket of 60 Hv or more, the loosening of the spark plug mounted to the combustion apparatus can be effectively restrained. Conceivably, this is for the following reason: the thermal deformation of the gaskets at a high temperature was restrained.

From the results of the test mentioned above, in order to restrain, over a long period of time, positional deviation of a forward end portion of the metallic shell (ground electrode) in the course of use while airtightness is ensured, by means of restraint of loosening of the spark plug, preferably, the Vickers hardness of the gasket is 60 Hv or more.

Figure 9:
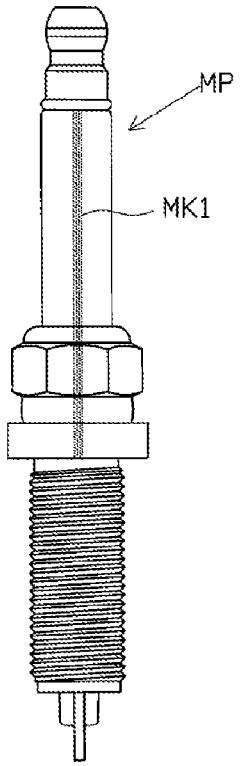
FIG. 9 is a front view showing the configuration of a master plug.
Figure 10:
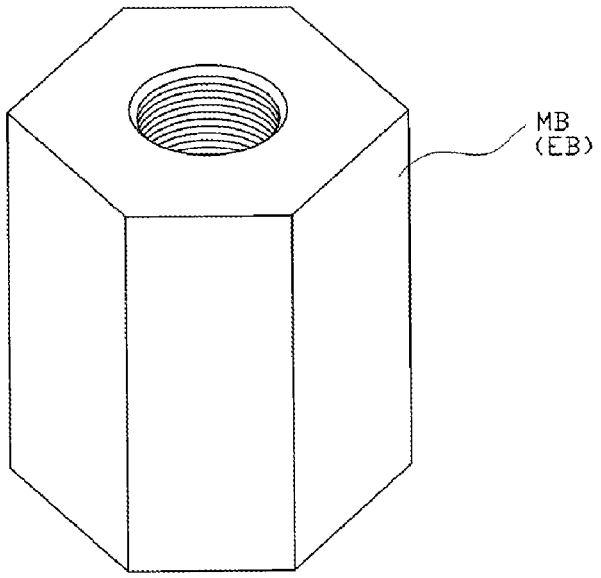
FIG. 10 is a perspective view showing the configuration of a master bush and a test bush.
Figure 11:
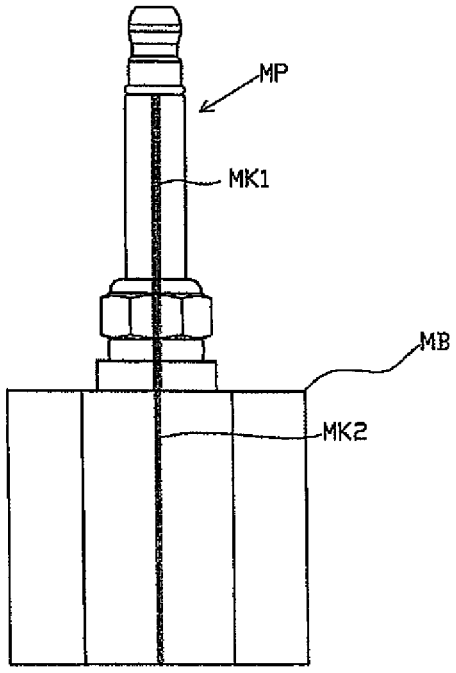
FIG. 11 is a front view showing the master bush marked in alignment with the mark of the master plug.
Figure 12A:
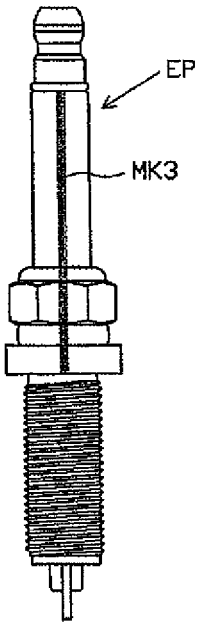
FIGS. 12(*a*) and 12(*b*) are a set of views wherein (a) shows a test plug marked in accordance with the mark of the master plug, and (b) shows a test bush marked in accordance with the mark of the master bush.
Figure 12B:
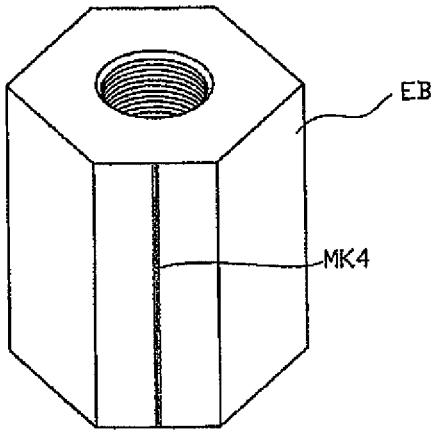

Next, there were manufactured spark plug samples whose gaskets had convexly curved surface portions formed between the forward end surfaces and the outer side surfaces and which differed in the radius R of curvature of the curved surface portion. The samples were subjected to a positional-slip check test. The samples were manufactured as follows. There were manufactured a plurality of spark plug samples which were in a state before attachment of the gaskets and had the same shape of the externally threaded portion and the same position of joining the ground electrode to the metallic shell. One of the samples was taken as a master plug, and the remaining samples were taken as test plugs. As shown in FIG. 9, the master plug MP was marked with a mark MK1 in a region corresponding to the position of joining the ground electrode. Next, as shown in FIG. 10, there were manufactured a plurality of bushes each having an internally threaded portion formed on its inner circumferential surface for allowing the externally threaded portion to be threadingly engaged therewith. One of the bushes was taken as a master bush MB, and the remaining bushes were taken as test bushes EB. As shown in FIG. 11, the master plug MP was manually screwed into the master bush MB, and, when the seat portion of the master plug MP came into contact with the master bush NB, the master bush MB was marked with a mark MK2 in alignment with the mark MK1 of the master plug MP. Furthermore, as shown in FIG. 12, the test plugs EP and the test bushes EB were marked with a mark MK3 and a mark MK4 at the same positions as those of the mark MK1 and the mark MK2 of the master plug MP and the master bush MB, respectively. Then, gaskets GA which differed in the radius R of curvature were attached to the test plugs EP, thereby yielding the spark plug samples.

Figure 13:
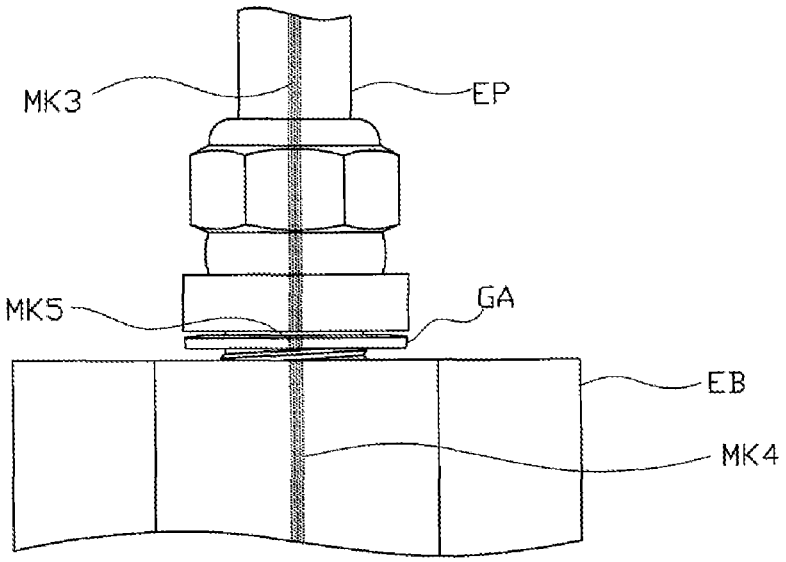
FIG. 13 is a front view for explaining marking on a gasket.
Figure 14:
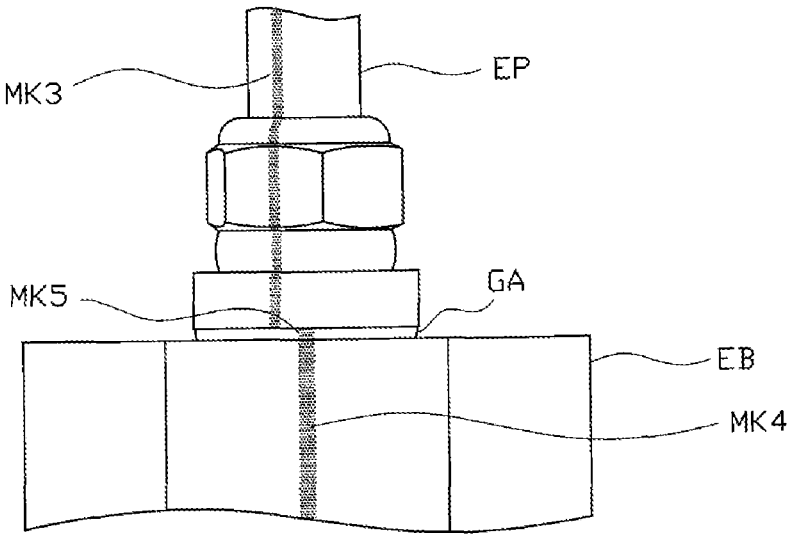
FIG. 14 is a front view showing the positional relation of the marks on the test plug and the gasket upon occurrence of slip between the test plug and the gasket.
Figure 15:
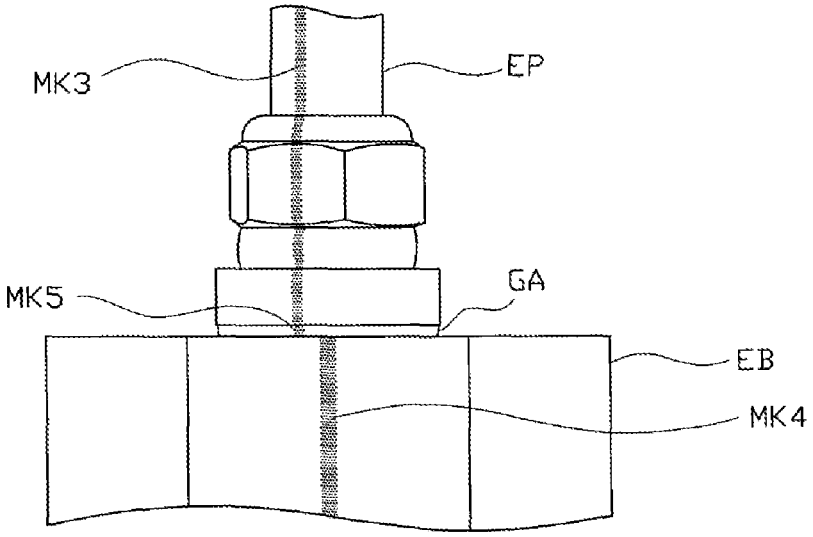
FIG. 15 is a front view showing the positional relation of the marks on the gasket and the test bush upon occurrence of slip between the gasket and the test bush.

Next, in the positional-slip check test, as shown in FIG. 13, the test plug EP was manually screwed into the test bush EB, and, in a stage immediately before the gasket GA came into contact with both of the seat portion of the test plug EP and the test bush EB and in which the mark MK3 of the test plug EP and the mark MK4 of the test bush EB were aligned with each other, the gasket GA was marked with a mark MK5 in alignment with the marks MK3 and MK4. In this condition, the test plug EP screwed into the test bush EB was tightened with a torque of 20 N·m. After tightening, the test plug EP, the test bush EB, and the gasket GA were checked for the positions of the marks MK3, MK4, and MK5, respectively. For example, as shown in FIG. 14, in the case where circumferential deviation arises between the mark MK3 of the test plug and the mark MK5 of the gasket GA, this indicates that a slip has occurred between the seat portion of the test plug EP and the gasket GA during tightening. Also, as shown in FIG. 15, in the case where circumferential deviation arises between the mark MK5 of the gasket GA and the mark MK4 of the test bush EB, this indicates that a slip has occurred between the gasket GA and the test bush EB during tightening. In this test, the case where no slip occurred between the gasket GA and the test bush EB was evaluated as "Good," and the case where a slip occurred between the gasket GA and the test bush EB was evaluated as "Fair." This evaluation is based on the following: if a slip occurs between the gasket GA and the test bush EB, friction may cause wear of the gasket or the generation of aluminum powder from the combustion apparatus, potentially resulting in unstable friction between the gasket and the combustion chamber and, in turn, adverse effect on the accuracy of positioning of a forward end portion of the metallic shell when the spark plug is mounted to the combustion apparatus. Table 5 shows the results of the test. Table 5 also shows, for reference, the presence/absence of a slip between the test plug EP and the gasket GA.

TABLE 5

| R (mm) | Slip between test plug and gasket | Slip between gasket and test bush | Evaluation |
|---|---|---|---|
| 0.0 | Present | Absent | Good |
| 0.1 | Present | Absent | Good |
| 0.2 | Present | Absent | Good |
| 0.3 | Present | Present | Poor |
| 0.5 | Absent | Present | Poor |

As is apparent from Table 5, in the case of the samples having a radius R of curvature of the curved surface portion of 0.2 mm or less, a slip does not arise between the gasket and the test bush, indicating that positioning accuracy can be further improved. Conceivably, this is for the following reason: through employment of a radius of curvature of 0.2 mm or less, the gasket is in a state of being caught by the test bush, thereby further restraining a slip of the gasket on the test bush. Also, in the case where a protrusion protruding forward with respect to the direction of the axis is provided on a radially outer side of the inclined portion, the yield of similar actions and effects is conceived.

From the results of the test mentioned above, in order to further improve positioning accuracy, in the case where the gasket has a curved surface portion, preferably, the radius of curvature of the curved surface portion is 0.2 mm or less. Also, in view of further improvement of positioning accuracy, preferably, a protrusion is provided on a radially outer side of the inclined portion.

Next, gaskets each having the groove were manufactured by means of the jig imposing load on the ring-like metal plates which differed in the thickness T. The manufactured gaskets were checked for a crack. Table 6 shows whether or not a crack is present in the gaskets which differ in the thickness T. The gaskets (metal plates) had a hardness of 80 Hv, and the jig imposed a load of 1.5 t on the metal plates.

TABLE 6

| | Thickness (mm) | | | | | |
|---|---|---|---|---|---|---|
| | 0.5 | 0.8 | 1.0 | 1.2 | 1.5 | 2.0 |
| Crack | Present | Present | Absent | Absent | Absent | Absent |

As is apparent from Table 6, through employment of a thickness T of 1.0 mm or more, even when a relatively large load is imposed, cracking of the gasket can be restrained in forming the groove in the gasket (in attaching the gasket to the metallic shell), thereby providing a superior yield.

From the results of the test mentioned above, in order to improve yield, preferably, the thickness T of the gasket is 1.0 mm or more.

Next, gaskets each having the groove were manufactured by means of the jigs imposing loads on the ring-like metal plates which differed in hardness. The jigs were checked for damage resulting from formation of the grooves. Table 7 shows whether or not the jigs were damaged at the hardnesses. The gaskets (metal plates) had a thickness T of 1.5 mm. Also, loads to be imposed on the metal plates were determined so as to render the inside diameter of the gasket smaller than the thread diameter of the externally threaded portion (so as to prevent detachment of the gasket from the metallic shell). Table 7 also shows the loads imposed in forming the grooves.

As shown in Table 7, it has been confirmed that, through employment of a hardness of the gasket (metal plate) of 150 Hv or less, damage to the jig can be restrained.

From the results of the test mentioned above, in view of restraint of damage to the jig and improvement of working performance, preferably, the hardness of the gasket is 150 Hv or less.

The present invention is not limited to the above-described embodiment, but may be embodied, for example, as follows. Of course, applications and modifications other than those exemplified below are also possible.

Figure 16A:
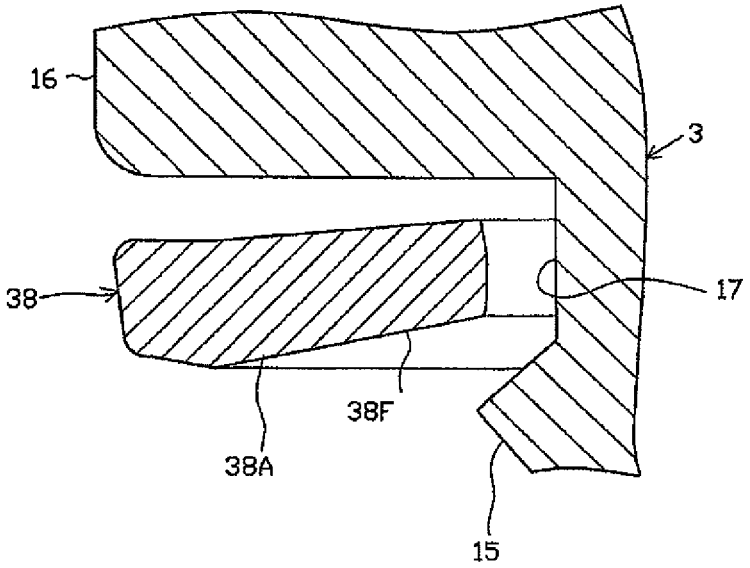
FIGS. 16(*a*) and 16(*b*) are enlarged fragmentary sectional views showing the configuration of a gasket according to another embodiment.
Figure 16B:
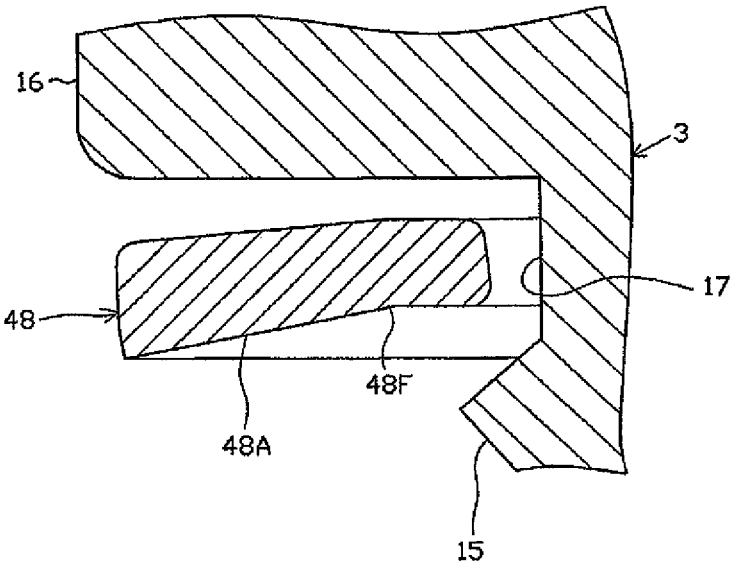

(a) In the above embodiment, the gasket 18 has the groove 18B provided on a side toward its inner circumference. However, as shown in FIGS. 16(*a*) and 16(*b*), forward end surfaces 38F and 48F of gaskets 38 and 48 may be flat without provision of the groove 18B. Also, in the above embodiment, the gasket 18 has the inclined portion 18A provided at a side toward the outer circumference thereof. However, as shown in FIG. 16(*a*), the gasket 38 may have an inclined portion 38A at a side toward the inner circumference thereof. The inside diameter of the gaskets 38 and 48 can be rendered smaller than the thread diameter of the externally threaded portion 15 without need to form the groove portion, by means of rolling the gasket in the direction of the axis CL1 while radially outward budging of the outer side surface of the gasket is restricted. Also, in the case of provision of the inclined portion 38A at the side toward the inner circumference of the gasket 38, preferably, a region of the forward end surface 38F of the gasket 38 located radially outward of the inclined portion 38A is inclined radially outward and rearward with respect to the direction of the axis CL1 from the radially inner side, so that in mounting the spark plug 1 to the combustion apparatus, the outer circumferential end of the inclined portion 38A comes into contact with the combustion apparatus.

Figure 17:
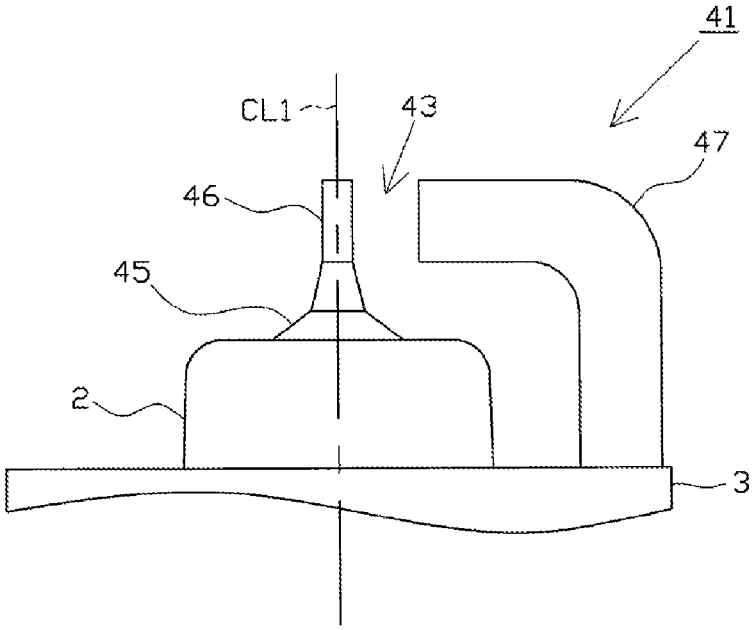
FIG. 17 is an enlarged front view showing the configuration of a spark plug according to another embodiment.

(b) In the above embodiment, the spark discharge gap 33 is formed between the forward end surface of the center electrode 5 (the noble metal tip 31) and a distal end portion (the other end portion) of the ground electrode 27, and a spark discharge is performed across the spark discharge gap 33 in a direction substantially along the axis CL1. By contrast, as shown in FIG. 17, a spark plug 41 may be configured as follows: a spark discharge gap 43 is formed between the side surface of a forward end portion of the center electrode 45 (a noble metal tip 46) and the distal end surface of a ground electrode 47, and a spark discharge is performed across the spark discharge gap 43 in a direction substantially orthogonal to the axis CL1.

Figure 18:
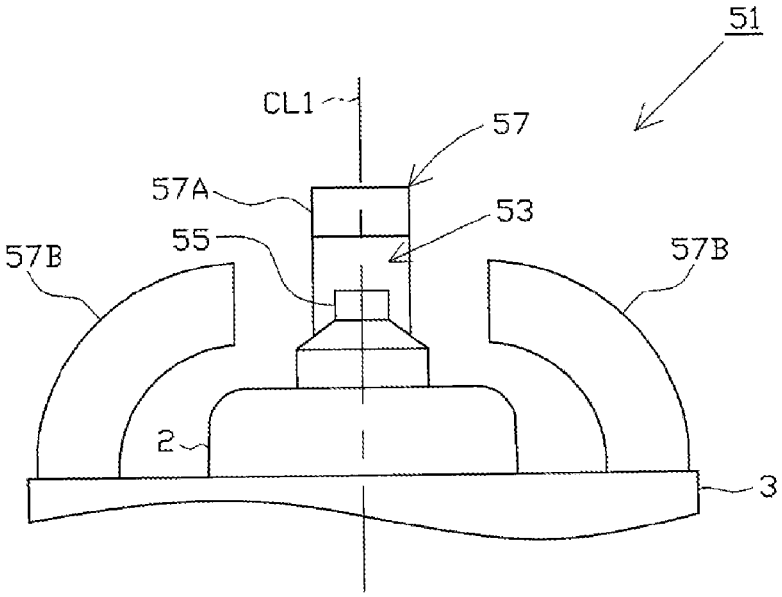
FIG. 18 is an enlarged front view showing the configuration of a spark plug according to a further embodiment.

Furthermore, as shown in FIG. 18, a spark plug 51 may be configured as follows: a ground electrode 57 is composed of a single main electrode 57A whose side surface of its distal end portion faces the forward end surface of a center electrode 55, and a plurality of sub-electrodes 57B which are shorter

TABLE 7

| | Hardness of gasket (Hv) | | | | | | | |
|---|---|---|---|---|---|---|---|---|
| | 40 | 50 | 60 | 80 | 100 | 150 | 180 | 200 |
| Damage | Absent | Absent | Absent | Absent | Absent | Absent | Present | Present |
| Load (ton) | 1.25 | 1.3 | 1.35 | 1.5 | 1.65 | 1.9 | 2.0 or more | 2.0 or more |

than the main electrode 57A and whose distal end portions face the side surface of a forward end portion of the center electrode 55, and a spark discharge is performed mainly across a spark discharge gap 53 formed between the main electrode 57A and the center electrode 55.

Figure 19:
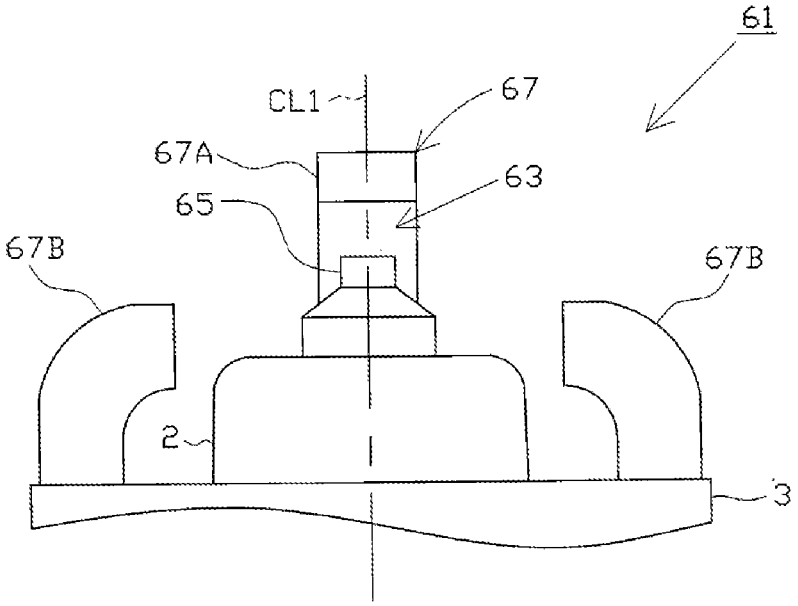
FIG. 19 is an enlarged front view showing the configuration of a spark plug according to a still further embodiment.

Additionally, as shown in FIG. 19, a spark plug 61 may be configured as follows: a ground electrode 67 is composed of a single main electrode 67A whose side surface of its distal end portion faces the forward end surface of a center electrode 65, and a plurality of sub-electrodes 67B which are shorter than the main electrode 67A and whose distal end portions face a forward end portion of the ceramic insulator 2, and a spark discharge is performed mainly across a spark discharge gap 63 formed between the main electrode 67A and the center electrode 65.

Figure 20:
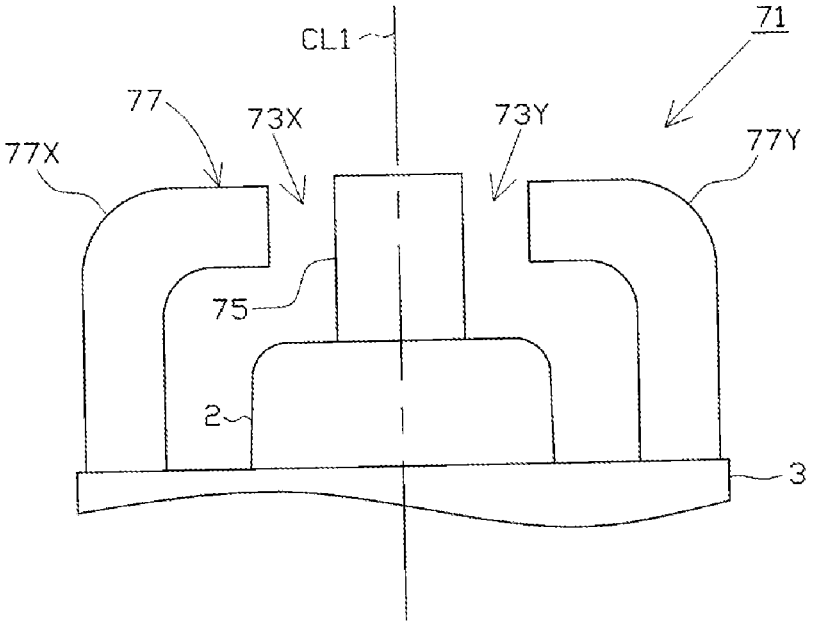
FIG. 20 is an enlarged front view showing the configuration of a spark plug according to yet another embodiment.

Also, as shown in FIG. 20, a spark plug 71 may be configured as follows: a ground electrode 77 is composed of two electrodes 77X and 77Y having the same length and facing each other with respect to the axis CL1, and a spark discharge is performed across spark discharge gaps 73X and 73Y formed between the side surface of a forward end portion of a center electrode 75 and the two electrodes 77X and 77Y, respectively.

The thus-configured spark plugs 41, 51, 61, and 71 potentially involve an extreme deterioration in ignition performance when mounted to the combustion apparatus EN in such a positional relation that the ground electrodes 47 and 77 (the main electrodes 57A and 67A) are present between a fuel injection device and the relevant spark discharge gaps. However, through employment of a distance L of 0.02 mm to 0.12 mm and a thickness T of 2.0 mm or less, when the spark plugs 41, 51, 61, and 71 are mounted to the combustion apparatus EN, the ground electrodes 47 and 77 (the main electrodes 57A and 67A) can be more reliably disposed at a fixed position in relation to the combustion chamber ER, whereby a deterioration in ignition performance can be more reliably prevented. In other words, the employment of a distance L of 0.02 mm to 0.12 mm and a thickness T of 2.0 mm or less is particularly effective for the spark plugs 41, 51, 61, 71 susceptible to the above-mentioned deterioration in ignition performance.

(c) According to the above embodiment, the ground electrode 27 is joined to a forward end portion of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(d) According to the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

(e) The above embodiment uses the jig JG having the tapered portion TP corresponding to the inclined portion 18A and inclining radially inward and rearward with respect to the direction of the axis CL1 from the radially outer side. However, the shape of the JG is not limited thereto. For example, there may be used a jig which has the annular protrusion PR corresponding to the groove 18B and in which a surface corresponding to the tapered portion TP is flat orthogonally to the axis CL1. By means of pressing the protrusion PR of the jig against the forward end surface of the metal plat MB, the forward end surface of the metal plate MB can be deformed to form the inclined portion 18A.

DESCRIPTION OF REFERENCE NUMERALS

1, 41, 51, 61, 71: spark plug
2: ceramic insulator (insulator)
3: metallic shell
4: axial bore
5: center electrode
15: externally threaded portion
16: seat portion
18: gasket
18A: inclined portion
18B: groove
18F: forward end surface
18G: outer side surface
18P: protrusion
18W: curved surface portion
27, 47, 57, 67, 77: ground electrode
33, 43, 53, 63, 73X, 73Y: spark discharge gap
57A, 67A: main electrode
57B, 67B: sub-electrode
CL1: axis
CL2: center axis (of gasket)
EN: combustion apparatus
ER: combustion chamber
FS: internally threaded portion
IW: inner wall surface

The invention claimed is:

1. A spark plug comprising:
a tubular metallic shell extending along an axis and
a solid annular gasket made of metal and provided externally of an outer circumference of the metallic shell,
the metallic shell having
an externally threaded portion formed on an outer circumference of a forward portion thereof and
a seat portion formed on a rear side of the externally threaded portion and protruding radially outward, and
the gasket having an inside diameter smaller than a thread diameter of the externally threaded portion and being provided between the externally threaded portion and the seat portion,
the spark plug being characterized in that
a forward end surface of the gasket has an inclined portion which inclines rearward with respect to a direction of the axis from a radially outer side toward a radially inner side,
a thickness of the gasket along the axis is 2.0 mm or less,
a distance along the axis between an outermost circumferential edge and an innermost circumferential edge of the inclined portion is 0.02 mm to 0.12 mm, and
a Vickers hardness of the gasket is 60 Hv or more.

2. A spark plug according to claim 1, wherein
the gasket has a convexly curved surface portion formed between the forward end surface and an outer side surface thereof, and
as viewed in a section which contains the axis, a radius of curvature of the curved surface portion is 0.2 mm or less.

3. A spark plug according to claim 1 or 2, wherein the gasket has a protrusion provided on a radially outer side of the inclined portion and protruding forward with respect to the direction of the axis.

4. A spark plug according to claim 1 or 2, wherein
the gasket has an annular groove about the axis on a radially inner side of the inclined portion, and
the thickness of the gasket along the axis is 1.0 mm or more.

5. A spark plug according to claim 1 or 2, wherein the Vickers hardness of the gasket is 150 Hv or less.

6. A spark plug according to claim 1 or 2, further comprising:

an insulator provided internally of an inner circumference of the metallic shell and having an axial bore extending therethrough in the direction of the axis, a center electrode provided at a forward end portion of the axial bore, and a rod-like ground electrode fixed to the metallic shell with a distal end portion thereof forming a spark discharge gap in cooperation with a forward end portion of the center electrode, wherein the ground electrode is composed of a single electrode.

7. A spark plug according to claim 1 or 2, further comprising:

an insulator provided internally of an inner circumference of the metallic shell and having an axial bore extending therethrough in the direction of the axis, a center electrode provided at a forward end portion of the axial bore, and a rod-like ground electrode fixed to the metallic shell with a distal end portion thereof forming a spark discharge gap in cooperation with a forward end portion of the center electrode, wherein the ground electrode is composed of a single main electrode forming the spark discharge gap in cooperation with a forward end surface of the center electrode and a sub-electrode whose distal end portion faces a forward end portion of the insulator or a side surface of a forward end portion of the center electrode and which is shorter than the main electrode.

8. A spark plug according to claim 1 or 2, further comprising:

an insulator provided internally of an inner circumference of the metallic shell and having an axial bore extending therethrough in the direction of the axis, a center electrode provided at a forward end portion of the axial bore, and a rod-like ground electrode fixed to the metallic shell with a distal end portion thereof forming a spark discharge gap in cooperation with a forward end portion of the center electrode, wherein the ground electrode is composed of two electrodes facing each other with respect to the axis.

9. A spark plug according to claim 1 or 2, wherein as viewed in a section which contains a center axis of the gasket, a width of a sectional region of the gasket between an innermost circumference and an outermost circumference along a direction orthogonal to the center axis is 2.7 mm or less.

10. An assembling structure of a spark plug in which the spark plug according to claim 1 or 2 is mounted to an internally threaded portion of a combustion apparatus, the spark plug comprising:

an insulator provided internally of an inner circumference of the metallic shell and having an axial bore extending therethrough in the direction of the axis, a center electrode provided at a forward end portion of the axial bore, and a ground electrode fixed to a forward end portion of the metallic shell with a distal end portion thereof forming a spark discharge gap in cooperation with a forward end portion of the center electrode, and an externally threaded portion of the metallic shell and the internally threaded portion of the combustion apparatus being formed such that, in a state in which the spark plug is mounted to the combustion engine, a center of the spark discharge gap of the spark plug is disposed at a predetermined relative position in relation to an inner wall surface of a combustion chamber of the combustion apparatus.

11. A spark plug comprising:

a tubular metallic shell extending along an axis and a solid annular gasket made of a single layer, metal plate and provided externally of an outer circumference of the metallic shell, the metallic shell having an externally threaded portion formed on an outer circumference of a forward portion thereof and a seat portion formed on a rear side of the externally threaded portion and protruding radially outward, and the gasket having an inside diameter smaller than a thread diameter of the externally threaded portion and being provided between the externally threaded portion and the seat portion, the spark plug being characterized in that a forward end surface of the gasket has an inclined portion which inclines rearward with respect to a direction of the axis from a radially outer side toward a radially inner side, a thickness of the single layer, metal plate along the axis is 2.0 mm or less, a distance along the axis between an outermost circumferential edge and an innermost circumferential edge of the inclined portion is 0.02 mm to 0.12 mm, and a Vickers hardness of the gasket is 60 Hv or more.

* * * * *